United States Patent [19]

Gmoch

[11] Patent Number: 5,054,198

[45] Date of Patent: Oct. 8, 1991

[54] CARTON OPENER

[75] Inventor: Richard Gmoch, Middletown, N.J.

[73] Assignee: Cosco Industries, Inc., Spring Valley, N.Y.

[21] Appl. No.: 548,110

[22] Filed: Jul. 5, 1990

[51] Int. Cl.[5] ..... B67B 7/00

[52] U.S. Cl. ..... 30/2; 30/335

[58] Field of Search ..... 30/2, 162, 335, 329, 30/336

[56] References Cited

U.S. PATENT DOCUMENTS

| | | | |
|---|---|---|---|
| 2,840,903 | 7/1958 | Christensen | 30/2 X |
| 3,178,812 | 4/1965 | Lurie | 30/2 |
| 3,195,231 | 7/1965 | Lightburn | 30/2 |
| 3,525,152 | 8/1970 | Fattori | 30/2 |
| 3,621,570 | 11/1971 | Kolde | 30/162 |
| 3,624,901 | 12/1971 | Pettit | 30/90.4 |
| 3,898,733 | 8/1975 | Cormier | 30/90.4 |
| 4,081,903 | 4/1978 | Cormier | 30/90.6 |
| 4,167,810 | 9/1979 | Gilbert | 30/2 |
| 4,433,484 | 2/1984 | Antisdel et al. | 30/90.4 |
| 4,570,342 | 2/1986 | Baum | 30/162 |
| 4,631,829 | 12/1986 | Schmidt et al. | 30/294 |
| 4,675,996 | 6/1987 | DuBuque | 30/2 |
| 4,744,146 | 5/1988 | Schmidt | 30/2 |

OTHER PUBLICATIONS

Exhibit A–Photographs of Tru–Kut box cutter and Photocopies of Packaging container for Tru–Kut box-cutter.)

*Primary Examiner*—Douglas D. Watts

*Attorney, Agent, or Firm*—Senniger, Powers, Leavitt & Roedel

[57] ABSTRACT

A carton opener comprising a razor blade holder and a sheath. The holder comprises a strip of sheet metal folded on itself to have first and second layers joined at one end. A blade is receivable between the layers adjacent the folded end. The strip at the folded end is cut away at one corner to receive and expose a corner of the blade and is rebated at an edge opposite the cut-away corner to receive the sides of the blade back. The layers are crimped adjacent the folded end to tightly grip the sides of the razor blade. The layers are joined together by striking the layers with a die from one side to form an indentation in one layer extending into the other layer to swage the layers together at the indentation and to form a boss in the other layer extending outwardly therefrom. The sheath comprises a body portion and a guide portion extending generally forward from a forward end of the body portion. The body portion is closely fitted about the holder and slidable thereon from a blade covering position to a sheath retracted position. The body portion further includes a notch in one face thereof for receiving the boss to serve as a positive stop for the holder when the sheath is moved to its retracted position. The guide portion is configured for guiding the corner of the blade along an edge of a carton.

5 Claims, 2 Drawing Sheets

CARTON OPENER

BACKGROUND OF THE INVENTION

This invention relates generally to an apparatus for holding a razor blade, and more particularly to such an apparatus which allows the razor blade to slide from a covered to an exposed position and is used to open packages and cartons.

Often it is convenient to use a razor blade to open items such as packages or cartons which have been securely taped. The blade is typically housed within a holder. Certain types of holders employ a sheath for covering the blade when it is not being used. Such a device is disclosed, for example, in U.S. Pat. No. 4,570,342 to Baum. The blade is exposed by sliding the sheath on the holder until the blade is exposed. Movement of the sheath on the holder to expose the blade is not positively limited in some such devices. Also, the blade is usually held in a folded-over strip of metal, the layers of which are secured together by spot welding which requires an additional processing step entailing relatively expensive electrical spot welding equipment or by swaging. Further, it is generally difficult to quickly and accurately guide the blades along an edge of a carton. Moreover, the blades are generally not tightly held within their holders and therefore tend to jump and/or snag the carton during operation.

SUMMARY OF THE INVENTION

Among the objects of the present invention may be noted the provision of a carton opener having a razor blade holder and a sheath surrounding the blade holder and having a positive stop for limiting the movement of the blade in its exposed position; the provision of such a carton opener which has a guide portion configured for guiding the corner of the blade along an edge of a carton; the provision of a carton opener in which the blade holder is crimped adjacent the blade to tightly grip the sides of the razor blade and hold it in place with respect to the holder; and the provision of a carton opener which is of simple and economical construction and may be fabricated by simple stamping and mechanical forming operations.

Generally a carton opener of the present invention comprises a razor blade holder and a sheath. The holder comprises a strip of sheet metal folded on itself to have first and second layers joined at one end. A backed razor blade is receivable between the layers adjacent the folded end. The strip at the folded end is cut away at one corner to receive and expose a corner of the blade and is rebated at an edge opposite the cut-away corner to receive the sides of the razor blade back. The layers are crimped adjacent the folded end to tightly grip the sides of the razor blade and hold it in place with respect to the holder. The layers of the folded strip are joined together at a point adjacent the end thereof opposite the folded end by striking the layers with a die from one side to form an indentation in one layer extending into the other layer to swage the layers together at the indentation and to form a boss in the other layer extending outwardly therefrom. The sheath comprises a body portion and a guide portion extending generally forward from a forward end of the body portion. The body portion is closely fitted about the holder and slidable thereon from a blade covering position in which the body portion covers the blade to a sheath retracted position in which the corner of the blade extends out the forward end of the body portion and adjacent the guide portion. The body portion further includes a notch in one face thereof for receiving the boss of the holder and serving as a positive stop therefor when the sheath is moved to its retracted position, thereby to limit further movement of the holder and blade from the sheath. The guide portion is configured for guiding the corner of the blade along an edge of a carton.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
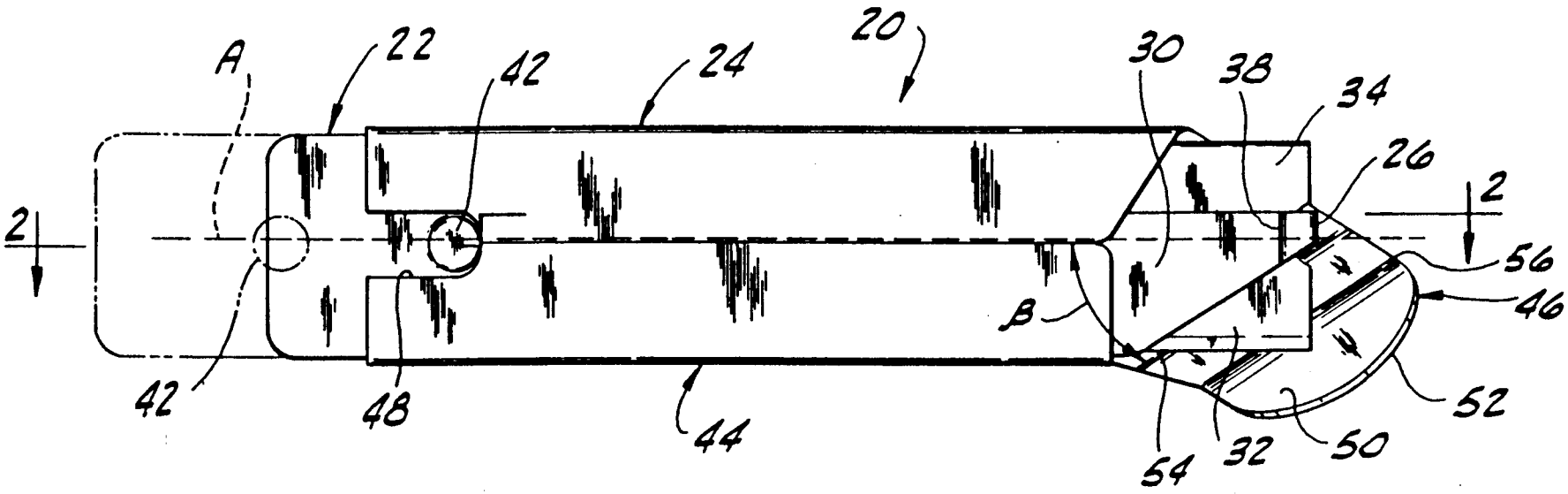
FIG. 1 is a plan view of a carton opener of this invention showing in solid lines the blade in an exposed position and showing the blade in covered position in phantom.
Figure 2:
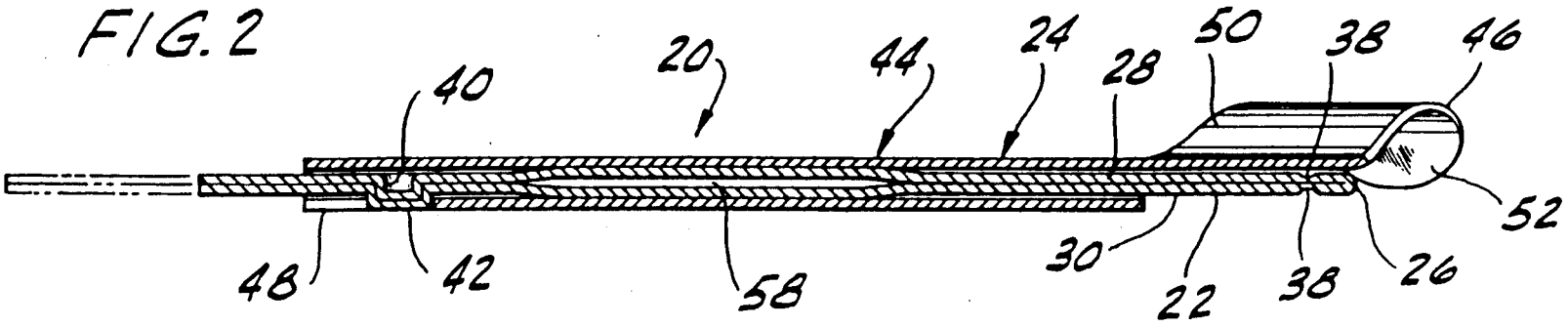
FIG. 2 is a section on line 2—2 of FIG. 1 with the razor blade removed.
Figure 3:
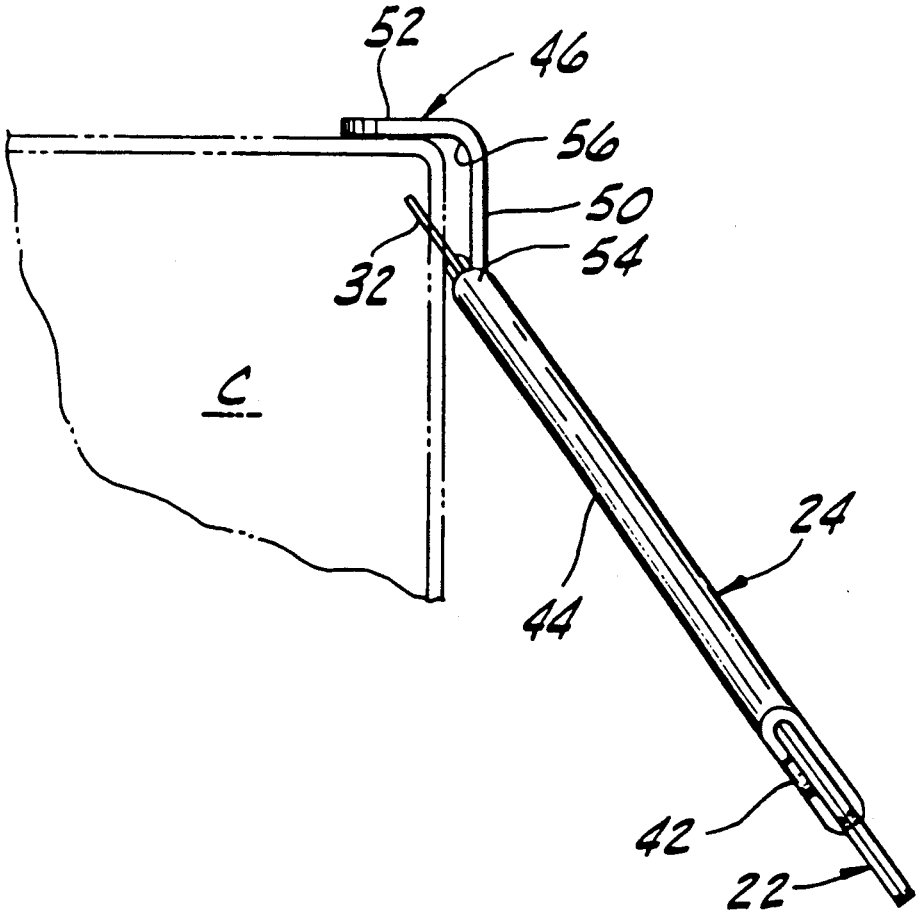
FIG. 3 is a top view of the carton opener showing the guide portion oriented against a carton for guiding the blade along the edge of the carton.

A carton opener constructed according to the principles of this invention is indicated generally as 20 in FIGS. 1-3. The opener includes a razor blade holder 22 and a sheath 24. The holder 22 comprises a strip of sheet metal folded on itself at 26 providing first and second layers 28 and 30 respectively, between which may be inserted the blade 32 of a single edge safety razor blade having a back 34. The blade illustrated is of a conventional type of construction with the blade being relatively stiff and having an inverted U-shaped channel strip secured over its top edge. The holder 22 has a thickness substantially equal to the thickness of the back 34 so that when the blade 32 is inserted between the first and second layers 28 and 30, the back will not protrude outwardly beyond the layers. One corner of both layers 28 and 30 at the folded end of the strip is removed as indicated at 36 to expose one corner of the blade 32. At the top of the strip as viewed in FIG. 1 there are formed rebates in layers 28 and 30 extending rearwardly from fold 26 and these are substantially equal in height and length to the dimensions of the back 34.

The layers 28 and 30 are crimped together adjacent the folded end to form creases 38 in the layers. The creases 38 tightly grip the sides of the razor blade 32 and hold it in place with respect to the holder 22. Since, during operation, the blade 32 does not move or shift with respect to the holder 22, binding of the blade in the carton is reduced and the cutting by the blade is smooth and clean.

The layers are joined together at a point adjacent the rearward end by a staking or swaging operation effected by striking the layers with a die to deform the metal and swage the layers together thereby forming an indentation 40 in layer 28 and a boss 42 in layer 30. This may be accomplished in the production process which involves principally a stamping and cutting operation and folding without the need to put the folded holder through a spot welding operation which entails delays, expensive equipment, and substantial energy costs.

The sheath 24 is of a generally flattened tubular form. The sheath 24 has a body portion 44 and a guide portion 46. The length of the body portion 44 is somewhat shorter than the length of the holder 22. The body portion 44 is configured to closely fit about and be slidable on the holder 22 from a sheath retracted position to a blade covering position. In the sheath retracted position, shown in full lines in FIGS. 1 and 2, the forward portion of the holder 22 and the lower corner of the blade 32 is exposed for use. In the blade covering position, indicated by dotted lines in FIGS. 1 and 2 and achieved by sliding the holder 22 rearwardly in the sheath 24, the entire blade is covered by the body portion 44. The body portion 44 has a notch 48 in one of its sides in which the boss 42 slides as the holder is moved in the body portion 44 to the sheath retracted position. The notch 48 provides a positive stop of the forward movement of the holder in the sheath as the boss 42 bottoms at the end of the notch 48.

The guide portion 46 is configured for guiding the corner of the blade 32 along an edge of a carton. The guide portion 46 includes first and second generally planar panels 50 and 52. The first panel 50 extends generally forward from the forward end of the body portion 44 and the plane of the first panel 50 is angled obliquely with respect to the plane of the body portion 44. The second panel 52 extends generally forward from the first panel 50. The plane of the first panel 50 is generally normal to the plane of the second panel 52. The body portion 44 and the guide portion 46 are integrally formed. The first panel 50 extends from the body portion 44 at a first bend line 54 and the second panel 52 extends from the first panel 50 at a second bend line 56. The first bend line 54 forms an oblique angle $\beta$ of approximately 30 degrees with the longitudinal axis A of the body portion 44. Preferably, the first and second bend lines 54 and 56 are generally parallel. As shown in FIG. 3, the second panel 52 engages an edge of a carton C to guide the corner of the blade 32 along the edge of the carton C for cutting the edge.

It is to be understood that whenever the exposed corner of the blade 32 becomes worn or damaged the holder 22 is removed from the body portion 44 and the position of the blade 32 is reversed in the holder 22 so as to expose the other corner, or the blade may be replaced with a new blade. It is also noted that the layers 28 and 30 are spaced or spread apart slightly as indicated at 58 between the boss 42 and the folded end. This causes the outer surfaces of layers 28 and 30 in that area to be biased slightly into contact with the inner surfaces of the body portion 44 to provide a friction fit. This fit reduces the possibility of inadvertent slipping of the holder 22 and blade 32 in the body portion 44 to a blade exposed position.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limited sense.

What is claimed is:

1. A carton opener comprising:

a razor blade holder comprising a strip of sheet metal folded on itself to have first and second layers joined at one end, a backed razor blade being receivable between said layers adjacent the folded end, said strip at the folded end being cut away at one corner to receive and expose a corner of the blade and being rebated at an edge opposite the cut-away corner to receive the sides of the razor blade back, said layers being crimped adjacent the folded end to tightly grip the sides of the razor blade and hold it in place with respect to said holder, the layers of said folded strip being joined together at a point adjacent the end thereof opposite the folded end by striking the layers with a die from one side to form an indentation in one layer extending into the other layer to swage the layers together at the indentation and to form a boss in the other layer extending outwardly therefrom; and a sheath comprising a body portion and a guide portion extending generally forward from a forward end of the body portion, said body portion being closely fitted about said holder and slidable thereon from a blade covering position in which the body portion covers the blade to a sheath retracted position in which the corner of the blade extends out the forward end of the body portion and adjacent the guide portion, said body portion further having a notch in one face thereof for receiving the boss of said holder and serving as a positive stop therefor when the sheath is moved to its retracted position, thereby to limit further movement of the holder and blade from the sheath, said guide portion being configured for guiding said corner of the blade along an edge of a carton.

2. The carton opener of claim 1 wherein said guide portion includes first and second generally planar panels, said first panel extending generally forward from the forward end of said body portion, said second panel extending generally forward from the first panel, the plane of said first panel being generally normal to the plane of said second panel.

3. The carton opener of claim 2 wherein the plane of said first panel is angled obliquely with respect to the plane of said body portion.

4. The carton opener of claim 3 wherein said guide portion and said body portion are integrally formed, said first panel extending from said body portion at a first bend line, the second panel extending from the second panel at a second bend line, the first bend line forming an oblique angle with the longitudinal axis of the body portion.

5. The carton opener of claim 4 wherein said first and second bend lines are generally parallel.

* * * * *